US005935910A

United States Patent [19]

Das

[11] Patent Number: 5,935,910

[45] **Date of Patent: *Aug. 10, 1999**

[54] HIGH POWER SUPERCONDUCTIVE FILTERS

[76] Inventor: Satyendranath Das, P.O. Box 574, Mt View, Calif. 94042-0574

[ * ] Notice: This patent is subject to a terminal disclaimer.

[21] Appl. No.: 08/566,679

[22] Filed: Dec. 4, 1995

Related U.S. Application Data

[62] Division of application No. 08/291,702, Aug. 16, 1994, Pat. No. 5,496,795.

[51] Int. Cl.[6] ..... H01P 1/208; H01P 1/209; H01B 12/02

[52] U.S. Cl. ..... 505/210; 505/700; 505/701; 505/866; 333/209; 333/212; 333/99 S

[58] Field of Search ..... 333/209, 212, 333/99 S; 505/210, 700, 701, 866

[56] References Cited

U.S. PATENT DOCUMENTS 5,459,123 10/1995 Das ..... 333/209 X
5,496,795 3/1996 Das ..... 505/210
5,589,440 12/1996 Das ..... 333/99 S X

*Primary Examiner*—Benny T. Lee

[57] ABSTRACT

The high power band-pass filters are made of sections of circular waveguide resonators with sections of waveguide in between them. In the center of the waveguide resonator a ferroelectric disc, with a hole in the center, is placed. A bias is applied to the inner side of the ferroelectric disc. On the application of a bias voltage, the permittivity of the ferroelectric disc changes. As a result, the resonant frequency of the circular cavity changes. Application of different levels of bias voltages produces different resonant frequencies of the filter. The interior conducting surfaces of the waveguide(s) and the waveguide resonator(s) have high Tc superconducting material and the waveguide flanges have high Tc superconducting material on the conducting surfaces.

The band-stop filters are made of a section of a main waveguide with branch waveguide resonator(s) connected on the broad-wall of the main waveguide with waveguide sections in between the resonators. A ferroelectric circular disc, with a hole in the middle, is placed in the middle of the branch guide. The branch waveguide loaded resonator is tuned to the dominant mode resonant frequency. A bias voltage is applied to the inner side of the ferroelectric disc changing the permittivity of the ferroelectric material and consequently changing the resonant frequency of the band reject filter.

19 Claims, 6 Drawing Sheets

HIGH POWER SUPERCONDUCTIVE FILTERS

This is applicaton is a division of application Ser. No. 08/291,702, filed Aug. 16, 1994 U.S. Pat. No. 5,496,795 issued Mar. 5, 1996.

Reference U.S. Pat. No. 5,496,795 was issued on March, 1996.

FIELD OF INVENTION

The present invention relates to filters of electromagnetic waves and more particularly to RF filters.

DESCRIPTION OF PRIOR ART

In many fields of electronics, it is necessary to filter or pass or block signals dependent on their frequencies. Commercial filters are available for such tasks.

For high power applications, waveguide filters are used. In one configuration, one or more waveguide resonators are used and they are connected through waveguides. In the band-pass version, the waveguide resonators and the waveguide sections are connected one after another in a chain. W. W. Mumford, "Maximally-flat filters in Waveguide," Bell System Technical Journal, pp. 684–712, 1948. Waveguides and resonators are generally built of copper sometimes with gold plating on the conducting surfaces. These filters have finite losses which increase with increasing number of sections and operating frequency used.

In the stop-band or band reject or band elimination version of the filter, a main waveguide section is used and waveguide resonators are placed on the top of the broad-wall of the waveguide with a section of waveguide in between them. The waveguides and resonators are generally built of copper sometimes with gold plating on the conducting surfaces. These filters have finite losses which increase with the increasing number of sections and operating frequency used. P. A. Rizzi, Microwave Engineering passive circuits, Prentice Hall, Engelwood Cliffs, N.J. 07632, pp. 457–462.

Ferroelectric materials have a number of attractive properties. Ferroelectrics can handle high peak power. The average power handling capacity is governed by the dielectric loss of the material. They have low switching time (such as 100 nS). Some ferroelectrics have low losses. The permittivity of ferroelectrics is generally large, as such the device is small in size. The ferroelectrics are operated in the paraelectric phase, i.e. slightly above the Curie temperature. Inherently, they have a broad bandwidth. They have no low frequency limitation as in the case of ferrite devices. The high frequency operation is governed by the relaxation frequency, such as 95 GHz for strontium titanate, of the ferroelectric material. The loss of ferroelectric tunable filter is low with ferroelectric materials with a low loss tangent. A number of ferroelectric materials are not subject to burnout. Ferroelectric devices are reciprocal

SUMMARY OF THE INVENTION

The purpose of the present invention is to provide filters with losses significantly lower than the room temperature filters of comparable design.

In the high Tc superconducting high power filter, the conducting surfaces are made of a high Tc superconducting material significantly reducing the losses. In one version, the waveguides and the waveguide resonator(s) are made of a high Tc superconducting single crystal material including YBCO, TBCCO. In another version, the waveguides and the waveguide resonator(s) are made of a good quality single crystal dielectric including sapphire, lanthanum aluminate the conducting surfaces of which are deposited with a film of single crystal high Tc superconducting material including YBCO, TBCCO. The waveguide flanges are made of a single crystal high Tc superconducting material. The waveguides and the resonator(s) are connected through waveguide flanges. The surface resistance of these devices are reduced at least by a factor of ten by the use of high Tc superconducting material. Low loss filters are particularly important for high power as well as low noise applications. Significant amount of RF power is lost, even with a low loss filter. The high Tc superconductiong filters will provide a significant benefit in high power and very low noise large antenna earth station, such as INTELSAT systems.

The high power band-pass filters are made of sections of circular waveguide resonators with sections of waveguide in between them. In the center of the waveguide resonator a ferroelectric disc, with a hole in the center, is placed. A bias is applied to the inner side of the ferroelectric disc. Upon the application of a bias voltage, the permittivity of the ferroelectric disc changes. As a result, the resonant frequency of the circular cavity changes. Application of different levels of bias voltages produces different resonant frequencies of the filter. The interior conducting surfaces of the waveguide(s) and the waveguide resonator(s) have high Tc superconducting material and the waveguide flanges have high Tc superconducting material on the conducting surfaces.

The band-stop filters are made of a section of a main waveguide with branch waveguide resonator(s) connected on the broad-wall of the main waveguide with waveguide sections in between the resonators. A ferroelectric circular disc, with a hole in the middle, is placed in the middle of the branch guide. The branch waveguide loaded resonator is tuned to the dominant mode resonant frequency. A bias is applied to the inner side of the ferroelectric disc changing the permittivity of the ferroelectric material and consequently changing the resonant frequency of the band reject filter.

One purpose of this invention is to lower the losses of the filters below those of the conventional room temperature filters of comparable design. Another object of this design is to design high power filters to handle power levels of at least 0.5 Megawatt. G. Shen, C. Wilker, P. Pang and W. L. Holstein, "High Tc Superconducting-sapphire Microwave resonator with Extremely high Q-Values Up To 90K," IEEE MTT-S Digest, pp. 193–196, 1992.

These and other objectives are achieved in accordance with the present invention. The waveguide resonators are , generally, operated in the dominant mode. The waveguide resonator, in the circular waveguide case, has a length which is typically one half guide wavelength, at the operating frequency of the filter, with an iris, which could be inductive or capacitive. The presence of the irises changes the resonant frequency of the waveguide resonators. The separation, measured between the centers of the adjacent waveguide resonators, is typically three quarters of a guide wavelength. The interior conducting surfaces of the waveguides and the waveguide resonators are deposited with a film or made of a single crystal high Tc superconducting material including YBCO, TBCCO. There are two approaches to this. In one, each waveguide section and the waveguide resonator, the waveguide flange, and iris is made of a high Tc superconducting single crystal material including YBCO, TBCCO. In the second version, each waveguide section, waveguide resonator, waveguide flange and the iris is made of a good quality single crystal dielectric including sapphire, lanthanum aluminate the interior conducting surfaces of which are deposited with a film of a single crystal high Tc superconducting material including YBCO, TBCCO.

With these and other objectives in view, as well hereinafter be more particularly pointed out in detail in the appended claims, reference is now made to the following description taken in connection with accompanying diagrams.

DESCRIPTION OF THE PREFERRED EMBODIMENTS

Figure 1:
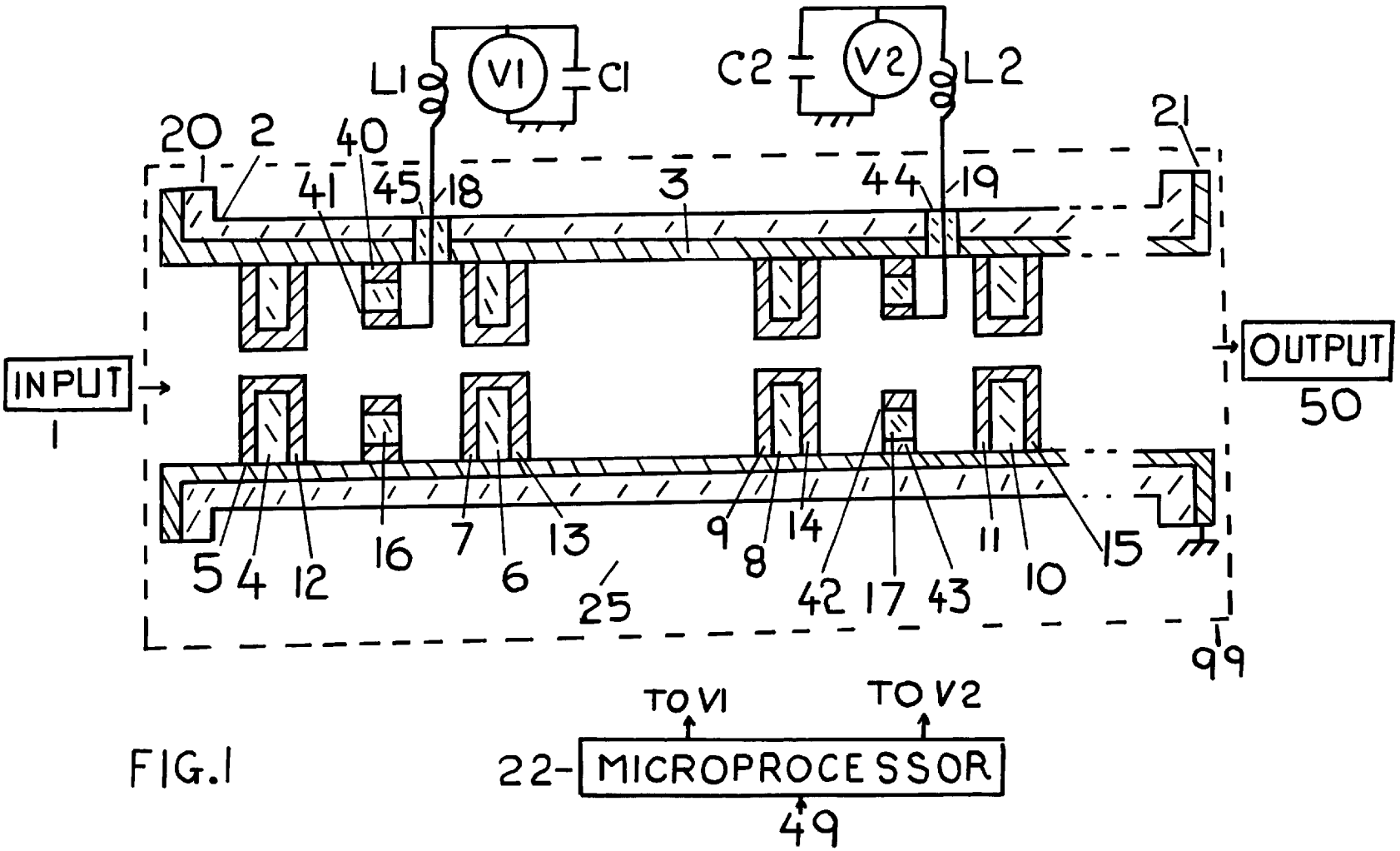
FIG. 1: Longitudinal cross-section of a circular waveguide, made of a single crystal dielectric whose surfaces, in contact with conductors, are deposited with a film of a single crystal high Tc superconductor, tunable band pass filter.

Now referring to the drawings, in FIG. 1 there is depicted an embodiment of the present invention. It is a circular waveguide ferroelectric tunable band pass filter. It consists of an input 1, an output 50 and a transmission line 25. The transmission line consists of a circular waveguide 2 made of a very good quality single crystal dielectric material including sapphire and lanthanum aluminate. The conducting surfaces of the dielectric material are deposited with a film 3 of a single crystal high Tc superconductor including YBCO and TBCCO. The transmission line 25 contains four irises 4, 6, 8, 10 which are made of a very good quality single crystal dielectric material. The conducting surfaces 5, 7, 9, 11 and 12, 13, 14, 15 are deposited with a film of single crystal high Tc superconductor material. A respective ferroelectric disc 16, 17, with a circular hole inside it, are located between each pair 4, 6 and 8, 10 of irises. There are two circular waveguide cavities in the transmission line 25. A respective cavity is made of an iris 4, 6 and 8, 10 on either side of the cavity loaded with a ferroelectric disc 16 and 17 in the center. The conducting depositions on ferroelectric discs16 and 17 are designated 40, 41 and 43, 42 respectively. The two circular surfaces of the ferroelectric discs are deposited with a conductor. For extremely low loss applications, the conductor is a film of a single crystal high Tc superconductor. Each cavity is tuned to the dominant resonant frequency. The separation distance between the centers of the two cavities is typically three quarters of a guide wavelength at the operating frequency of the filter. The inner side of the ferroelectric disc 16 and 17 are each connected by respective wires 18 and 19 respectively for applying a bias voltage. Bias insulators are 45 and 44. Each inductance L1 and L2 is connected to the respective wires 18 and 19 and provides a high impedance to the RF energy. Any remaining RF energy after the inductance is short circuited by each capacitor C1 and C2 respectively. The respective bias voltage source is V1 and V2. The flanges are 20 and 21. The flanges are made of a good single crystal dielectric material, the conducting surfaces of which are deposited with a film of a single crystal high Tc superconductor. Application of a bias voltage to a ferroelectric disc changes its permittivity and the resonant frequency of the cavity in which it is located. Application of different levels of bias voltages tunes the cavity to different resonant frequencies. As a result a tunable band pass filter is obtained. A table is prepared with levels of bias voltages versus resonant frequencies of each cavity. This table is included in the memory of a microprocessor 22. For a narrow band application, each cavity is tuned to the same resonant frequency. The number of cavities of the filter is determined by the out of band rejection required by the filter. For a broader band operation, each cavity is tuned to a staggered frequency. A microprocessor is used to control the bias level of each ferroelectric disc for the required resonant frequency of each cavity. The cryocooler for keeping the tunable filter at the high superconducting Tc is 99. The high superconducting Tc, currently, is 77–105° K. With an input fed at 1, an output is obtained at 50. The filter is reciprocal. With an input at 50, the output is obtained at 1. The filter is operated at a constant temperature slightly above its Curie temperature.

All ferroelectric materials and ferroelectric liquid crystals (FLC) are included in this disclosure. One example is $Sr_{1-x}Pb_xTiO_3$ where the value of x is between 0.005 and 0.7. The Curie temperature of $SrTiO_3$ is ~37° K. By adding a small amount of $PbTiO_3$ the Curie temperature is increased to slightly below the high superconducting Tc i.e. 70–98° K. Another example is $KTa_{1-x}Nb_xO_3$ where the value of x is between 0.005 and 0.7. A third example is $Sr_{1-x}Ba_xTiO_3$ where the value of x is between 0.005 and 0.7. The major component of the filter loss is the dielectric loss. The loss tangent of each $KTaNbO_3$ and $SrTiO_3$ is low. The magnitude of the permittivity and the loss tangent can be reduced by making a composition of polythene powder and a powdered ferroelectric material having a high value of permittivity. Only two cavities are shown in FIG. 1. A filter is made of 1, 2, 3 . . . n section of cavities with 0, 1, 2, . . . (n−1) waveguide sections between them. The separation distance between the centers of the adjacent cavities is typically three quarters of a wavelength at the operating frequency of the filter.

Figure 2:
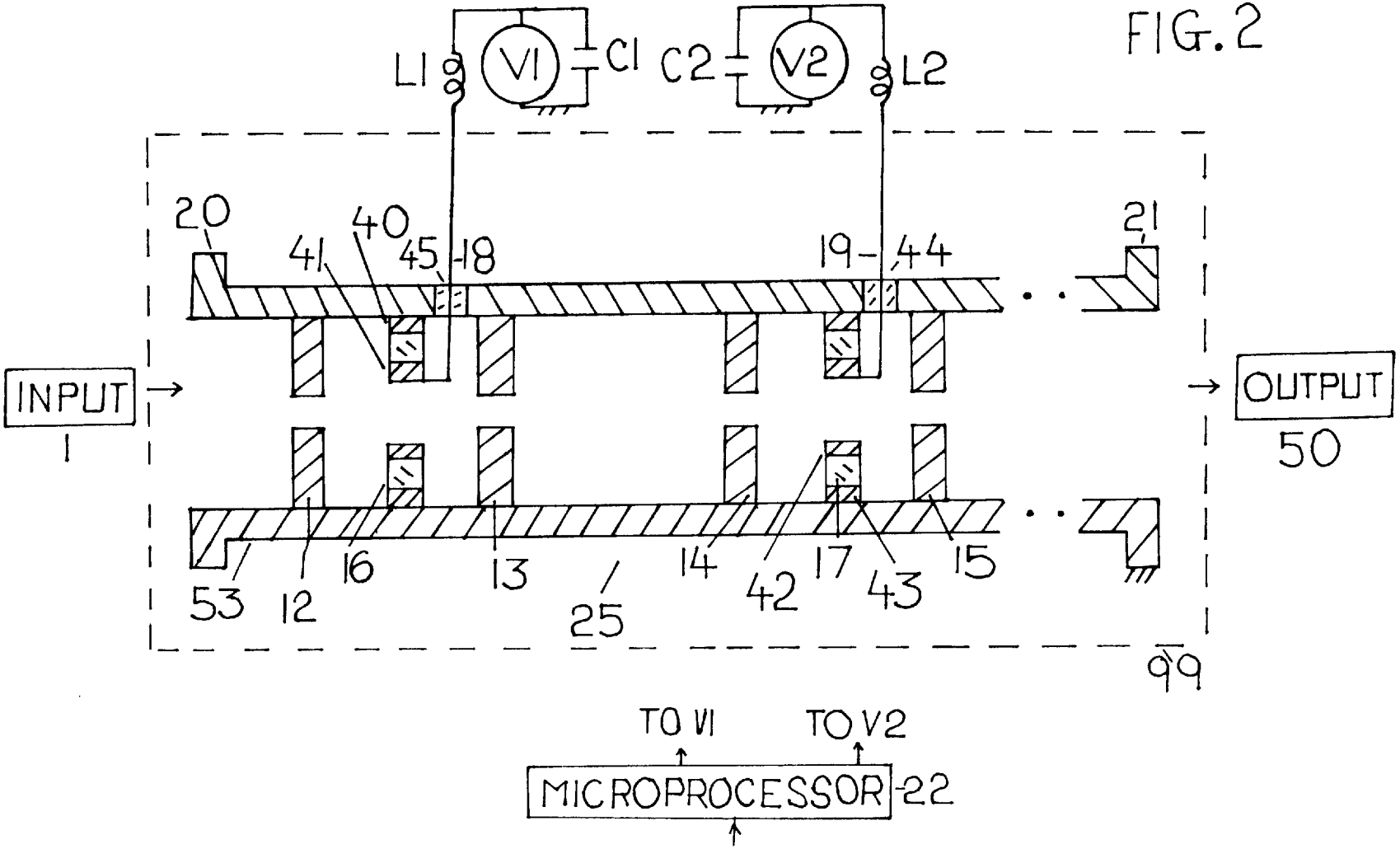
FIG. 2: Longitudinal cross-section of a circular waveguide tunable band pass filter.

In FIG. 2 there is depicted a tunable band pass filter. The circular waveguide 53 is made of a single crystal high Tc superconductor. The irises 62, 63, 64, 65 are made of a single crystal high Tc superconductor. The ferroelectric circular discs are 16 and 17. The conducting depositions on ferroelectric discs 16, 17 are designated 40, 41 and 43, 42 respectively. The flanges 20 and 21 are made of a single crystal high Tc superconductor. The biasing wires are 18 and 19. Bias insulators are 45 and 44. The inductances L1 and L2 provide high impedance to the RF energy. The rest of the discussions of FIG. 1 are applicable here in its entirety.

FIG. 2 also depicts a normal room temperature circular waveguide tunable band pass filter. The Curie temperature of the ferroelectric disc is slightly below the operating room temperature. The element 99 is the means for keeping the tunable filter at a constant temperature and at a high superconducting Tc. Same reference numbers/labels, in FIG. 1 through FIG. 6, refer to the same element previously described.

Figure 3:
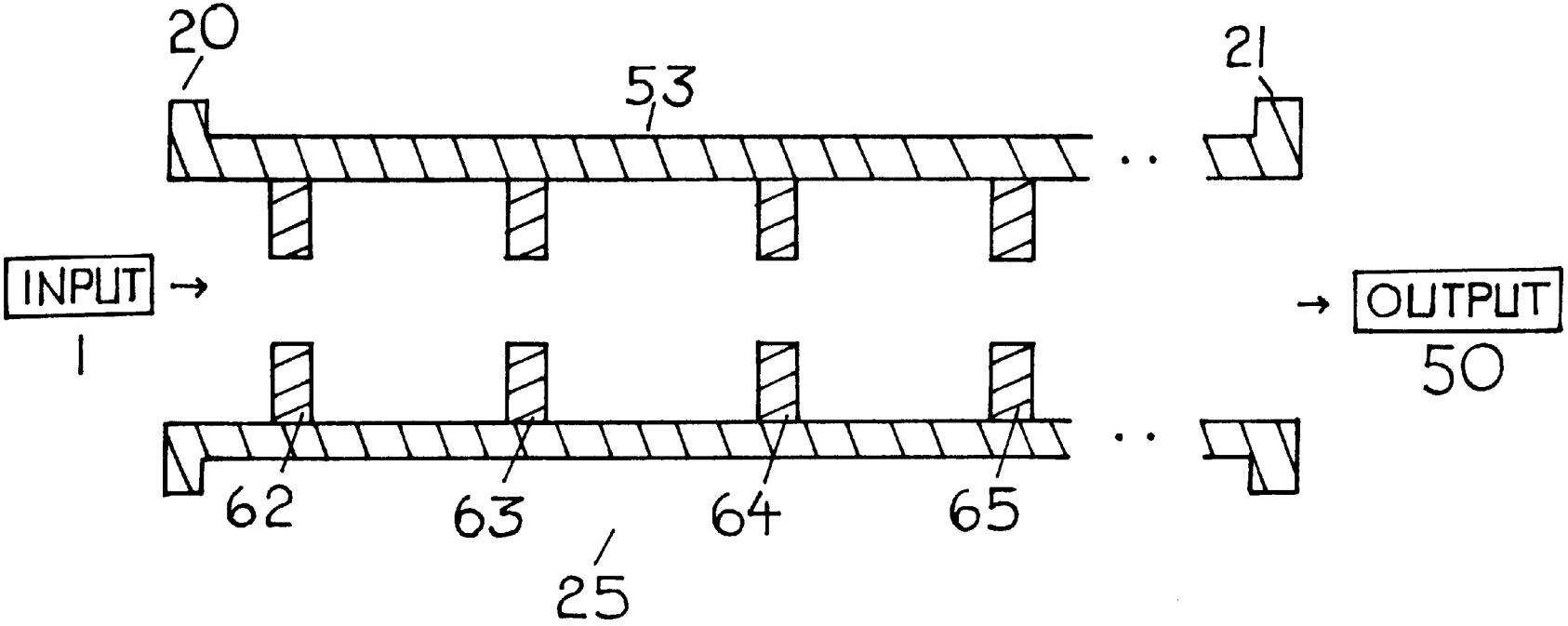
FIG. 3: Longitudinal cross-section of a circular waveguide band pass filter.

In FIG. 3, there is depicted a circular waveguide band pass filter. The circular waveguide 53 is made of a single crystal high Tc superconductor. The irises 62, 63, 64, 65 are made of a single crystal high Tc superconductor. The flanges 20 and 21 are made of a single crystal high Tc superconductor. The length of each cavity is typically one half of a guide wavelength at the operating frequency of the filter foreshortened by the reactance of the irises. The separation distance between the centers of the two cavities is typically three quarters of a guide wavelength at the operating frequency of the filter. For a narrow band filter, all the cavities are tuned to the same dominant mode resonant frequency. The number of cavities is determined by the attenuation required outside the pass band. For a broader bandwidth band pass filter, the adjacent cavities are tuned to staggered frequencies. The waveguide sections are connected together by flanges. Although two cavities are shown in FIG. 3, the filter can have 1, 2, 3 . . . n sections of cavities and 0, 1, 2, . . . (n−1) sections of waveguides, as shown by dotted lines, between them depending on the filter requirements. The separation distance between the centers of cavities is typically three quarters of a wavelength at the operating frequency of the filter.

Figure 4:
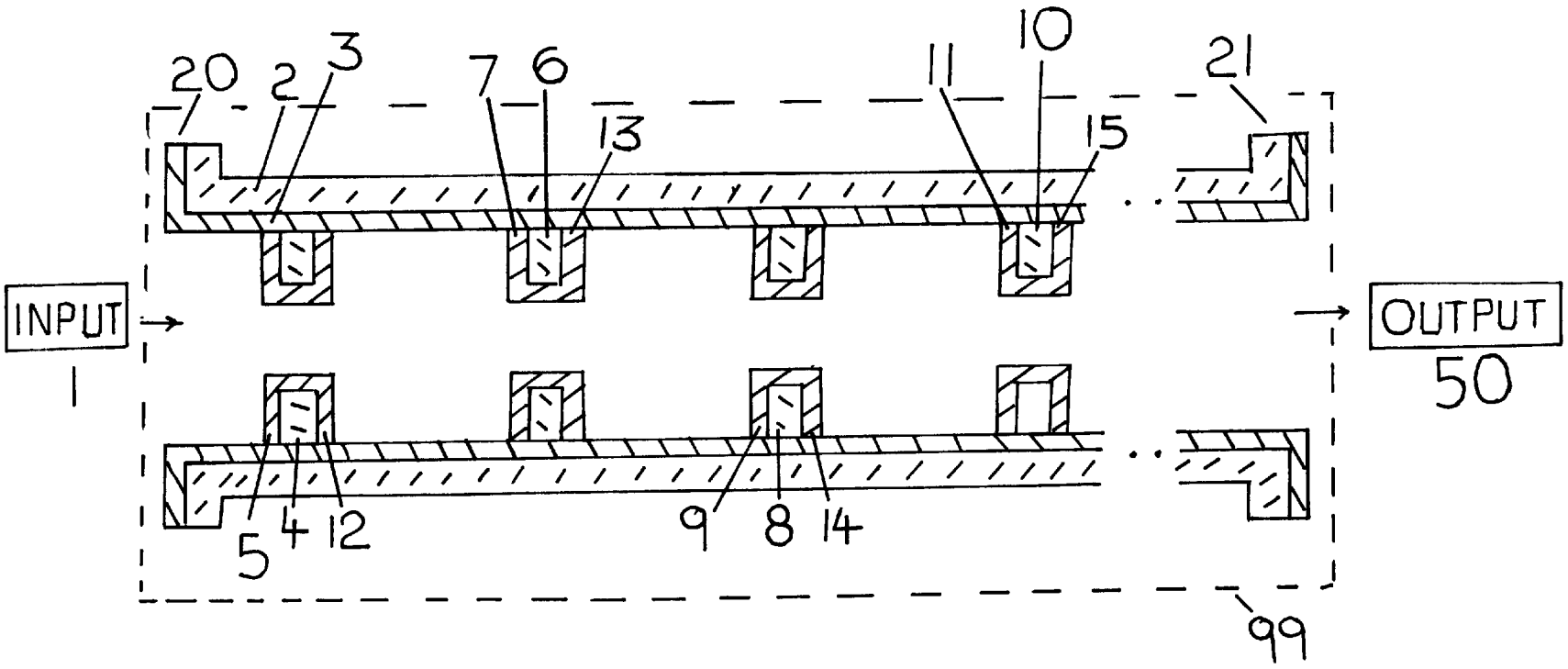
FIG. 4: Longitudinal cross-section of circular waveguide, made of a single crystal dielectric the surfaces of which, in contact with conductors, are deposited with a film of a single crystal high Tc superconductor, band pass filter.

In FIG. 4, there is depicted another embodiment of a circular waveguide band pass filter. The waveguide is made of a good single crystal dielectric material. The conducting surfaces of the dielectric material 2 are deposited with a film 3 of a single crystal high Tc superconductor. The irises are 4, 6, 8, 10 and are made of a single crystal dielectric material The conducting surfaces 5, 7, 9, 11 and 12, 13, 14, 15 of the irises 4, 6, 8, 10 are deposited with a film of a single crystal high Tc superconductor. The irises are also made of a single crystal high Tc superconductor. The flanges are 20 and 21. The flanges are made of a single crystal high Tc superconductor and a good single crystal dielectric material the conducting surfaces of which are deposited with a film of a single crystal high Tc superconductor. The flanges and irises are connected to the waveguide. The waveguide sections are connected together. The waveguide sections with flanges are connected together through the flanges. For a narrow band filter, the cavities are tuned to the same resonant frequency. The number of cavities are determined by the attenuation required outside the pass band. For a broader bandwidth band pass filter, the cavities are staggered tuned. Only two cavities are shown in FIG. 4. The filter has 1, 2, 3, 4 . . . n number of cavities and 0, 1, 2, 3, . . . (n−1) of waveguide sections in between them, as shown by dots, depending on filter requirements. The element 99 is the cryocooler the means for keeping the filter at high superconducting Tc which is currently between 77–105° K or a constant temperature device.

Figure 5:
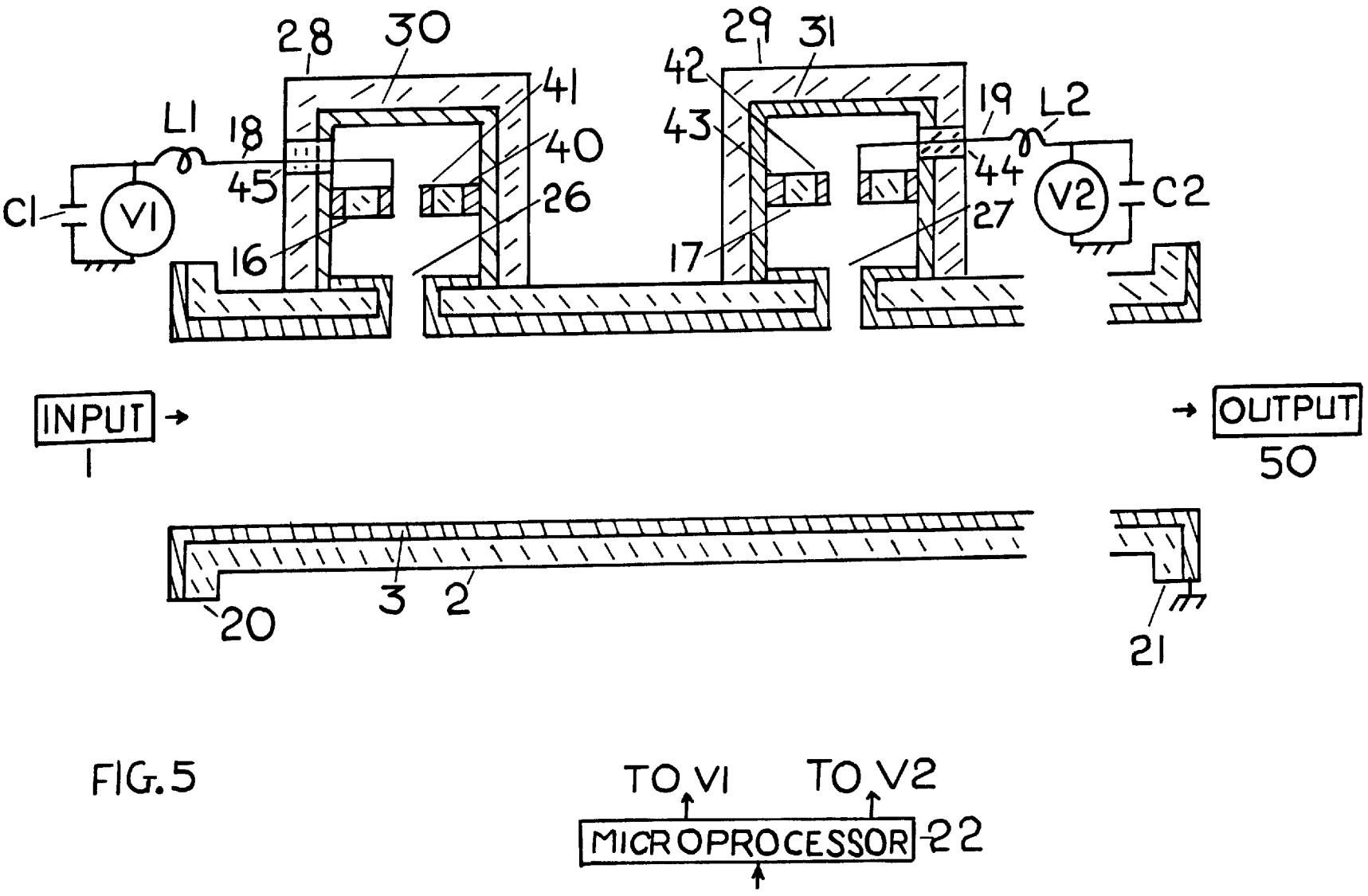
FIG. 5: Longitudinal cross-section of a circular waveguide, made of a single crystal dielectric the surfaces of which, in contact with conductors, are deposited with a film of a single crystal high Tc superconductor, band reject filter.

In FIG. 5, there is depicted another embodiment of this invention, a circular waveguide tunable band reject filter. The main circular waveguide is made of a single crystal dielectric material the conducting surfaces of which are deposited with a film of a single crystal high Tc superconductor. A respective branch circular waveguide 28 and 29 is connected to the main dielectric waveguide 2. The conducting surfaces 30, 31 of the respective cavity 28 and 29 are deposited with a film a single crystal high Tc superconductor. The respective cavity 28 and 29 is loaded with a ferroelectric disc 16, 17, with a circular hole inside it. The conducting depositions on ferroelectric discs16 and 17 are designated 40, 41 and 43, 42 respectively. A respective biasing wire 18 and 19 is connected to the inner part of each circular disc 16 and 17 respectively. The inductances L1 and L2 provide a high impedance to the RF energy. The capacitances C1 and C2 provide a low impedance to the RF energy. The capacitances C1 and C2 provide a low impedance to the RF energy remaining after the inductances. The respective cavity is 28 and 29 and is coupled to the circular waveguide 2 through coupling holes 26 and 27 respectively. The respective loaded cavity 28 and 29 is tuned to the dominant resonant frequency. The separation distance between the centers of the cavities is typically three quarters of a wavelength at the operating frequency of the filter. At the resonant frequency of the cavity, the filter provides a rejection of that frequency band. Upon the application of a bias voltage to the ferroelectric circular disc 16, its permittivity changes resulting in a change in the resonant frequency of the cavity. With application of different levels of bias voltages, different resonant frequencies of the cavity are obtained. In FIG. 5 only two cavities are shown. In a tunable band reject filter, 1, 2, 3. . . n cavities are used depending on the requirements with 0, 1, 2, . . . (n−1)th waveguide sections, as shown by dots, between the cavities. The separation between the centers of adjacent a waveguides is typically three quarters of wavelength at the operating frequency of the filter. For a narrow bandwidth band reject filter, all the cavities are tuned to the same dominant resonant frequency. The number of resonant cavities is dependent on the attenuation to meet the band reject filter requirements. To obtain a broader bandwidth band reject filter, the adjacent cavities are staggered tuned. A table is prepared giving the level of bias voltages to each ferroelectric disc versus resonant frequencies of each cavity and the data are included in the memory of a microprocessor 22. The microprocessor controls the level of bias voltage of each ferroelectric circular disc to give the required resonant frequency of each cavity.

Figure 6:
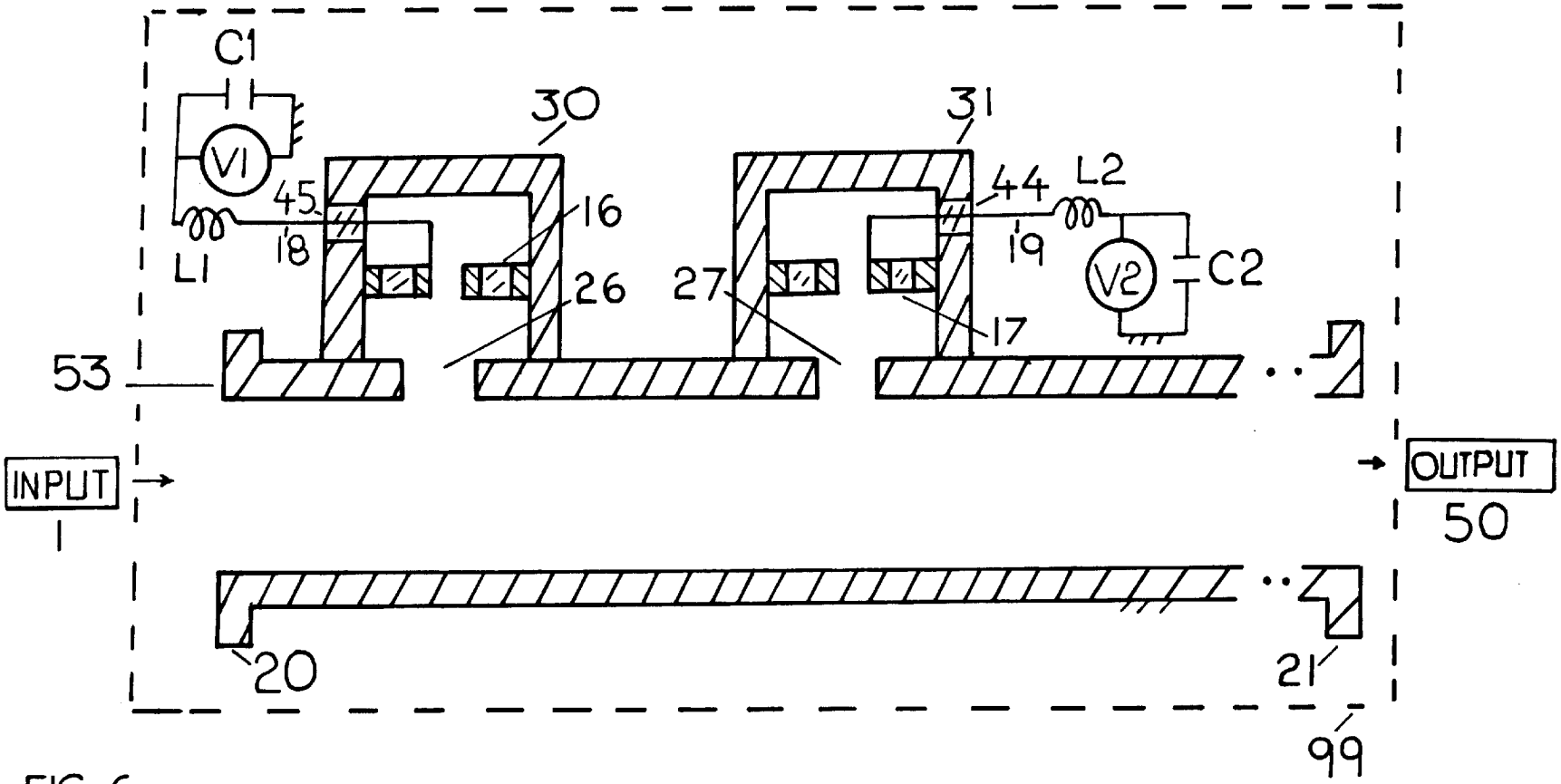
FIG. 6: Longitudinal cross-section of a circular waveguide tunable band reject filter.

In FIG. 6, there is depicted another embodiment of this invention, a band reject circular waveguide, made of a single crystal high Tc superconductor, filter. The circular waveguide 53. The flanges are 20, 21. The two branch cavities are 30, 31. The ferroelectric discs, with circular holes inside them, are 16, 17. The connecting wires are 18, 19. The bias inductances are L1 and L2. The bias capacitances are C1 and C2. The coupling holes are 26, 27. The loaded cavities are tuned to the dominant resonant frequency of the cavities. The separation distance between the cavities is three quarters of a guide wavelength at the operating frequency of the filter. At the resonant frequency of the cavities, band rejection takes place. For operation of the band reject tuned filter, the discussions of FIG. 5 are applicable here.

It should be understood that the foregoing disclosures relate to only typical embodiments of the invention and that numerous modifications or alternatives may be made therein, by those of ordinary skill, without departing from the spirit and scope of the invention as set forth in the appended claims. Different frequencies, types of waveguides, all ferroelectric materials, compositions of ferroelectric materials with powder polythene and other low permittivity materials, ferroelectric liquid crystals (FLC) and high Tc superconductors are contemplated in this invention.

What is claimed is:

1. A high Tc superconducting high power band pass tunable filter having first through nth circular waveguide resonators, first through nth ferroelectric discs whose permittivity is dependent on a bias electric field, a Curie temperature, an input, an output, a loaded resonant frequency, a dominant mode, a single crystal dielectric material and comprising of:

a body of a high Tc superconducting circular waveguide main transmission line;

a first high Tc superconducting transmission means for coupling RF energy into said body;

said first high Tc superconducting circular waveguide resonator, approximately being one half of a guide wavelength long, at an operating frequency of the filter, and being part of said main transmission line, with said irises;

said first ferroelectric disc, with a hole therein, having said permittivity , being placed in the center of said first waveguide resonator, the loaded resonant frequency of which is tuned to said dominant mode;

first voltage means to independently apply said bias electric field to said first ferroelectric disc to change the permittivity thereof and said loaded resonant frequency of said first resonator;

said second high Tc superconducting circular waveguide resonator, approximately being one half of a guide wavelength long, at said operating frequency of the filter, and being part of said main transmission line, with said irises;

said second ferroelectric disc, with a hole therein, having said permittivity, being placed in the center of said second waveguide resonator, the loaded resonant frequency of which is tuned to said dominant mode;

second voltage means to independently apply said bias electric field to said second ferroelectric disc to change the permittivity thereof and said loaded resonant frequency of said second resonator;

a first high Tc superconducting main circular waveguide section connected between said first and second waveguide resonators providing a separation between the centers of said resonators being approximately three quarters of a guide wavelength long at said operating frequency of the filter;

said third, fourth . . . nth high Tc superconducting circular waveguide resonators, each approximately being one half of a guide wavelength long, at said operating frequency of the filter, and being part of said main transmission line, with corresponding irises thereof being connected with said first and second waveguide resonators;

said third, fourth . . . nth ferroelectric discs, each with a respective hole therein, having said permittivity, being placed in the center of said third, fourth . . . nth waveguide resonators respectively, the loaded resonant frequency of which is tuned to said dominant mode;

the surfaces of said respective ferroelectric discs having a conductor film in contact with conductors of said waveguides;

different voltage means to independently apply said bias electric field to said third, fourth . . . nth ferroelectric discs to change the permittivity thereof and said loaded resonant frequency of said third, fourth . . . nth cavities respectively;

a second, third . . . (n−1)th high Tc superconducting circular waveguide sections, providing a separation distance between the centers of said two adjacent waveguide resonators of approximately three quarters of a guide wavelength long, at said operating frequency of the filter and being connected to said first and second waveguide resonators;

a second high Tc superconducting transmission means for coupling RF energy out of said body;

said high Tc superconducting circular waveguide sections comprised of said single crystal dielectric materials and inner surfaces thereof with a film of a single crystal high Tc superconducting material;

said high Tc superconducting circular waveguide resonators comprised of said single crystal dielectric materials and inner surfaces thereof with a film of said single crystal high Tc superconducting material;

said high Tc superconducting circular irises comprised of said single crystal dielectric materials and surfaces thereof with a film of said single crystal high Tc superconducting material;

circular waveguide flanges comprised of said single crystal dielectric materials and surfaces thereof with a film of said single crystal high Tc superconducting material; and means for keeping said high power tunable band pass filter at the high superconducting Tc slightly above the Curie temperature of said ferroelectric material.

2. A high Tc superconducting high power band pass tunable filter of claim 1:

wherein said single crystal dielectric material being sapphire, said single crystal ferroelectric material being $KTa_{1-x}Nb_xO_3$ and the value of x is between 0.005 and 0.7; and said high Tc superconducting material being TBCCO.

3. A high Tc superconducting high power band pass filter of claim 1:

wherein said single crystal dielectric material being sapphire, said single crystal ferroelectric material being $Sr_{1-x}Pb_xTiO_3$ and the value of x is between 0.005 and 0.7; and said high Tc superconducting material being YBCO.

4. A high Tc superconducting high power band pass tunable filter of claim 1 wherein said single crystal dielectric material is sapphire and said single crystal ferroelectric is

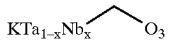

and the value of x is between 0.005 and 0.7.

5. A high Tc superconducting high power band pass tunable filter of claim 4 wherein said single crystal high Tc superconducting material is YBCO.

6. A high Tc superconducting high power band pass tunable filter of claim 1 wherein said single crystal dielectric material is lanthanum aluminate and said single crystal ferroelectric is $KTa_{1-x}Nb_xO_3$ and the value of x is between 0.005 and 0.7.

7. A high Tc superconducting high power band pass tunable filter of claim 6 wherein said single crystal high Tc superconducting material is TBCCO.

8. A high Tc superconducting high power band pass tunable filter of claim 1 wherein said single crystal dielectric material is lanthanum aluminate and said single crystal ferroelectric is $Sr_{1-x}Pb_xTiO_3$ and the value of x is between 0.005 and 0.7; and said single crystal high Tc superconducting material is TBCCO.

9. A high Tc superconducting high power band-reject tunable filter having circular waveguides, a broad wall, first through nth branch resonators, first through nth ferroelectric discs whose permittivity is dependent on a bias electric field and having a Curie temperature, an input, an output, a loaded resonant frequency, a dominant mode and comprising of:

a body of a high Tc superconducting circular main waveguide transmission line;

a first high Tc superconducting transmission means for coupling RF energy into said body;

said first high Tc superconducting branch circular waveguide resonator, approximately being one half of a guide wavelength long, at the operating frequency of the filter, and being separate from said main transmission line, and being connected to the broad wall of said main waveguide with a coupling hole between said branch resonator and said main waveguide;

said first ferroelectric disc, with a hole therein, having said permittivity, being placed in the center of said first waveguide resonator, the loaded resonant frequency of which is tuned to said dominant mode;

first voltage means to independently apply said bias electric field to said first ferroelectric disc to change the permittivity thereof and said loaded resonant frequency of said first resonator;

said second high Tc superconducting branch circular waveguide resonator, approximately being one half of a guide wavelength long, at said operating frequency of the filter, and being separate from said main transmission line, and being connected to the broad wall of said main waveguide with a coupling hole between said second branch circular resonator and said main waveguide;

said second ferroelectric disc, with a hole therein, having said permittivity, being placed in the center of said second waveguide resonator, the loaded resonant frequency of which is tuned to said dominant mode;

second voltage means to independently apply said bias electric field to said second ferroelectric disc to change the permittivity thereof and said loaded resonant frequency of said second resonator;

a first high Tc superconducting main circular waveguide section connected between said first and second waveguide resonators providing a separation between the centers of said first and second resonators being approximately three quarters of a guide wavelength long at said operating frequency of the filter;

said third, fourth . . . nth high Tc superconducting branch circular waveguide resonators, each branch resonator approximately being one half of a guide wavelength long, at said operating frequency of the filter, and being separate from said main transmission line, with corresponding coupling holes and being connected to the broad wall of said main waveguide;

said third, fourth . . . nth ferroelectric discs, each with a respective hole therein, having said permittivity, being placed in the center of said third, fourth . . . nth waveguide resonators respectively, the loaded resonant frequency of which is tuned to said dominant mode;

surfaces of said ferroelectric discs having a conductor film in contact with conductors of said waveguides;

different voltage means to independently apply said bias electric field to said third, fourth . . . nth ferroelectric discs to change the permittivity and said loaded resonant frequency of said third, fourth . . . nth cavities respectively;

a second, third . . . (n−1)th high Tc superconducting main circular waveguide sections, providing a separation distance between the centers of said two adjacent waveguide resonators of approximately three quarters of a guide wavelength long, at said operating frequency of the filter and being connected between said two adjacent waveguide resonators;

a high Tc superconducting transmission means for coupling RF energy out of said body;

said high Tc superconducting circular waveguide sections comprised of single crystal high Tc superconducting materials;

said high Tc superconducting circular waveguide resonators comprised of single crystal high Tc superconducting materials;

said high Tc superconducting circular irises comprised of single crystal high Tc superconducting materials; and means for keeping the band stop filter at a high superconducting Tc slightly above the Curie temperature of said ferroelectric material.

10. A high Tc superconducting high power band reject tunable filter of claim 9 wherein said single crystal ferroelectric is $KTa_{1-x}Nb_xO_3$ and the value of x is between 0.005 and 0.7.

11. A high Tc superconducting high power band reject tunable filter of claim 10 wherein the single crystal high Tc superconducting material is YBCO.

12. A high Tc superconducting high power band reject tunable filter of claim 9 wherein said single crystal ferroelectric is $Sr_{1-x}Pb_xTiO_3$ and the value of x is between 0.005 and 0.7.

13. A high Tc superconducting high power band reject tunable filter of claim 12 wherein the single crystal high Tc superconducting material is YBCO.

14. A high Tc superconducting high power band reject tunable filter of claim 9 wherein the single crystal high Tc superconductor material is TBCCO.

15. A high Tc superconducting high power band pass tunable filter having first through nth circular waveguide resonators, first through nth ferroelectric discs whose permittivity is dependent on a bias electric field and having a Curie temperature, an input, an output, a loaded resonant frequency, a dominant mode, irises and comprising of:

a body of a high Tc superconducting circular waveguide main transmission line;

a first high Tc superconducting transmission means for coupling RF energy into said body;

said first high Tc superconducting circular waveguide resonator, approximately being one half of a guide wavelength long, at an operating frequency of the filter, and being part of said main transmission line, with said irises;

said first ferroelectric disc, with a hole therein, having said permittivity, being placed in the center of said first waveguide resonator, the loaded resonant frequency of which is tuned to said dominant mode;

first voltage means to independently apply said bias electric field to said first ferroelectric disc to change the permittivity thereof and said loaded resonant frequency of said first resonator;

said second high Tc superconducting circular waveguide resonator, approximately being one half of a guide wavelength long, at said operating frequency of the filter, and being part of said main transmission line, with said irises;

said second ferroelectric disc, with a hole therein, having said permittivity, being placed in the center of said second waveguide resonator, the loaded resonant frequency of which is tuned to said dominant mode;

second voltage means to independently apply said bias electric field to said second ferroelectric disc to change the permittivity thereof and said loaded resonant frequency of said second resonator;

a first high Tc superconducting main circular waveguide section connected between said first and second waveguide resonators providing a separation between the centers of said resonators being approximately three quarters of a guide wavelength long at said operating frequency of the filter;

said third, fourth . . . nth high Tc superconducting circular waveguide resonators, each resonator approximately being one half of a guide wavelength long, at said operating frequency of the filter, and being part of said main transmission line, with said corresponding irises and being connected with said first and second waveguide resonators;

said third, fourth . . . nth ferroelectric discs, each with a respective hole therein, having said permittivity, being placed in the center of said third, fourth . . . nth waveguide resonators respectively, the loaded resonant frequency of which is tuned to said dominant mode;

surfaces of said respective ferroelectric discs having a conductor film in contact with conductors of said waveguides;

different voltage means to independently apply said bias electric field to said third, fourth . . . nth ferroelectric discs to change the permittivity thereof and said resonant frequency of said third, fourth . . . nth cavities respectively;

a second, third . . . (n−1)th high Tc superconducting main circular waveguide sections, providing a separation distance between the centers of said two adjacent waveguide resonators of approximately three quarters of a guide wavelength long, at said operating frequency of the filter and being connected to said first and second waveguide resonators;

a first high Tc superconducting transmission means for coupling RF energy out of said body;

said high Tc superconducting circular waveguide sections comprised of said single crystal high Tc superconducting material;

said high Tc superconducting circular waveguide resonators comprised of said single crystal high Tc superconducting material;

said high Tc superconducting circular irises comprised of said single crystal high Tc superconducting material; and means for keeping the high power tunable band pass filter at the high superconducting Tc slightly above the Curie temperature of said ferroelectric material.

16. A high Tc superconducting high power band pass tunable filter of claim 15:

wherein said single crystal ferroelectric is $KTa_{1-x}Nb_xO_3$ and the value of x is between 0.005 and 0.7.

17. A high Tc superconducting high power band pass tunable filter of claim 16:

wherein the single crystal high Tc superconducting material is YBCO.

18. A high Tc superconducting high power band pass tunable filter of claim 15:

wherein the single crystal ferroelectric is $Sr_{1-x}Pb_xTiO_3$ and the value of x is between 0.005 and 0.7.

19. A high Tc superconducting high power band pass tunable filter of claim 18:

wherein said single crystal high Tc superconducting material is YBCO.

* * * * *